US006176222B1

(12) United States Patent
Kirwan et al.

(10) Patent No.: US 6,176,222 B1
(45) Date of Patent: Jan. 23, 2001

(54) ENGINE FUEL INJECTION CONTROL METHOD WITH FUEL PUDDLE MODELING

(75) Inventors: John E. Kirwan, Troy; Scott Willis Jorgensen, Bloomfield Township, Oakland County; Frederic Anton Matekunas; Chen-Fang Chang, both of Troy, all of MI (US)

(73) Assignee: General Motors Corporation, Detroit, MI (US)

( * ) Notice: Under 35 U.S.C. 154(b), the term of this patent shall be extended for 0 days.

(21) Appl. No.: 09/437,072

(22) Filed: Nov. 9, 1999

(51) Int. Cl.[7] ..... F02M 51/00
(52) U.S. Cl. ..... 123/492
(58) Field of Search ..... 123/492, 478, 123/480

(56) References Cited

U.S. PATENT DOCUMENTS

| | | | | |
|---|---|---|---|---|
| 4,621,603 | | 11/1986 | Matekunas | 123/425 |
| 4,624,229 | | 11/1986 | Matekunas | 123/425 |
| 5,283,117 | * | 2/1994 | Akase | 123/478 |
| 5,435,285 | * | 7/1995 | Adams et al. | 123/492 |
| 5,476,081 | * | 12/1995 | Okawa et al. | 123/478 |
| 5,584,277 | * | 12/1996 | Chen et al. | 123/492 |
| 5,611,315 | * | 3/1997 | Dohta et al. | 123/493 |
| 5,884,610 | * | 3/1999 | Reddy | 123/698 |
| 6,079,393 | * | 6/2000 | Tdutsumi et al. | 123/478 |

* cited by examiner

*Primary Examiner*—John Kwon
(74) *Attorney, Agent, or Firm*—George A. Grove

(57) ABSTRACT

An improved engine fuel control method which divides the liquid fuel into a plurality of components characterized by relative volatility. The mass and evaporation characteristics of each fuel volatility component are determined separately within the fuel puddle, with the overall puddle behavior being characterized as the sum of the behaviors of the individual volatility components. The method involves determining, for each engine cycle, the mass of fuel that will evaporate from the puddle, the mass of vapor required to achieve the desired air/fuel ratio for the engine cylinder, the fraction of the injected fuel that will vaporize, and the mass of fuel that needs to be injected in order to achieve the desired air/fuel ratio in the cylinder. Finally, the puddle mass is updated for the next intake event. In a preferred implementation, the liquid fuel is divided into first, second and third components respectively characterized by high, medium and low volatility, and the volatility is inferred based on a measure of the fired-to-motored cylinder pressure ratio.

8 Claims, 3 Drawing Sheets

ENGINE FUEL INJECTION CONTROL METHOD WITH FUEL PUDDLE MODELING

TECHNICAL FIELD

The present invention relates in general to an engine injection fuel control method that accounts for fuel puddling during cold start and warm-up conditions, and more particularly to a control that separately accounts for a plurality of fuel components based on volatility.

BACKGROUND OF THE INVENTION

Current state-of-the-art engine controls rely almost exclusively on exhaust gas sensing to maintain the engine air-fuel ratio at a value that minimizes exhaust emissions. However, such sensors typically require heating for a significant period before the sensor is useful for control following a cold start. For this reason, engine fueling during engine starting and warm-up is generally performed based on an open-loop calibration. Until the engine has warmed up, a significant amount of the injected fuel puddles on the engine manifold walls instead of immediately vaporizing for ingestion in the cylinder. The puddled fuel evaporates over time, so that the fuel vapor actually ingested into the cylinder is generated in part from the injected fuel and in part from the puddled fuel. The rate at which the injected and puddled fuel quantities vaporize depends not only on temperature and pressure, but also on the fuel volatility, which may vary considerably from tank to tank. To complicate matters even further, any given fuel sample actually comprises hundreds of compounds of widely varying volatility. Under warmed-up conditions, it may be assumed that the puddled fuel (if any) comprises primarily low volatility compounds, the behavior of which may be reasonably accurately characterized. However, during cold-start and warm-up, the puddled fuel contains a wide variety of compounds, the behavior of which is difficult to accurately characterize. Thus, for a given amount of injected fuel, the quantity of fuel vapor actually delivered to the cylinder depends both on the fuel volatility and the evaporative characteristics of the fuel puddle.

The above-described variability forces design engineers to enrich the cold calibration—and generally to be less aggressive with spark retard used to assist catalyst heating—to insure that operating with low volatility fuel will not result in driveability problems. This enrichment to compensate for low volatility fuels causes the air/fuel mixture to be richer than optimum with high volatility fuel, resulting in higher engine-out hydrocarbon emissions than if the appropriate calibration for that fuel were used. Additionally, the less aggressive spark retard delays the onset of "light-off" of the exhaust catalyst. Thus, it is apparent that differences in fuel volatility adversely affect both emissions and driveability with conventional control strategies.

Accordingly, what is needed is a control method for accurately injecting fuel so that the actual air/fuel mixture in the engine cylinder more nearly corresponds to the desired air/fuel mixture, particularly during coldstart and warm-up conditions.

SUMMARY OF THE INVENTION

The present invention is directed to an improved engine fuel injection control method which models the liquid fuel as a plurality of components characterized by relative volatility. The mass and evaporation characteristics of each fuel volatility component are determined separately within the fuel puddle, with the overall puddle behavior being characterized as the sum of the behaviors of the individual volatility components. The method involves determining, for each engine cycle, the mass of fuel that will evaporate from the puddle, the mass of vapor required to achieve the desired air/fuel ratio for the engine cylinder, the fraction of the injected fuel that will vaporize, and the mass of fuel that needs to be injected in order to achieve the desired air/fuel ratio in the cylinder. Finally, the puddle mass is updated for the next intake event.

In a preferred embodiment, the liquid fuel is divided into first, second and third components respectively characterized by high, medium and low volatility, and the volatility is inferred based on a measure of the fired-to-motored cylinder pressure ratio.

BRIEF DESCRIPTION OF THE DRAWINGS

FIG. 2 is a main flow diagram; FIG. 3 is an interrupt service routine for detecting fuel volatility and determining the mass fractions of the various injected liquid fuel components; and FIG. 4 details the determination and scheduling of fuel injection commands.

DESCRIPTION OF THE PREFERRED EMBODIMENT

Figure 1:
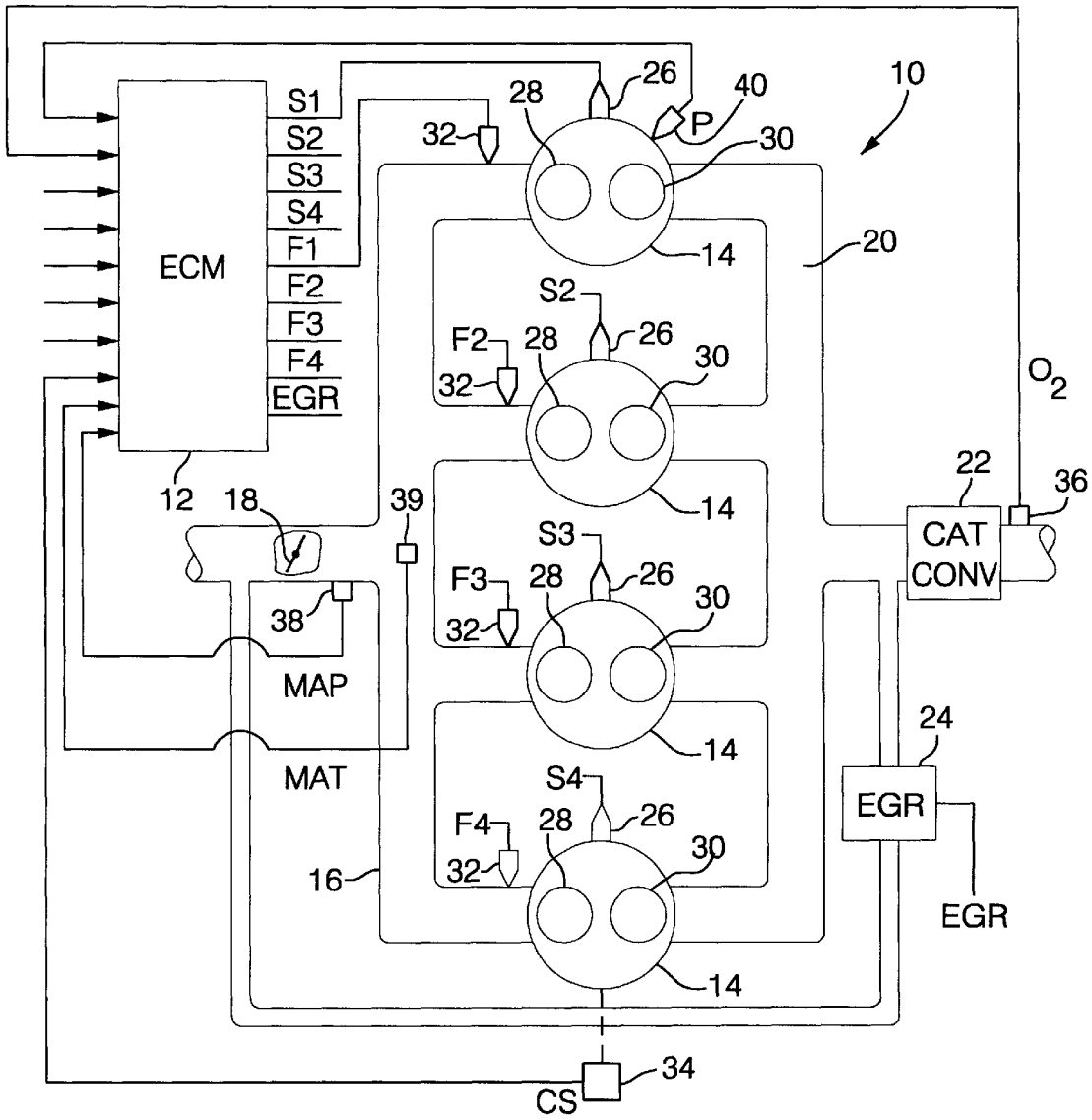
FIG. 1 is a diagram of an engine fuel control, including a microprocessor-based controller programmed according to this invention.

FIG. 1 depicts a motor vehicle internal combustion engine 10 and a microprocessor-based engine control module (ECM) 12. For purposes of illustration, the engine 10 is depicted as having four cylinders 14, an intake manifold 16 with throttle valve 18, and an exhaust manifold 20 with a three-way catalytic converter 22. An exhaust gas recirculation (EGR) valve 24 returns a portion of the exhaust gasses from the exhaust manifold 20 to the intake manifold 16. Each cylinder 14 is provided with a spark plug 26, an intake valve 28 coupled to the intake manifold 16, and an exhaust valve 30 coupled to the exhaust manifold 20. Fuel is delivered to the intake manifold 16 at each intake valve 28 by a respective fuel injector 32. Although not shown in FIG. 1, each cylinder 14 houses a piston which is mechanically coupled to a crankshaft, which in turn provides motive power to the vehicle through a transmission and drivetrain.

The ECM 12 receives a number of input signals representing various engine and ambient parameters, and generates control signals F1–F4 for the fuel injectors 32, S1–S4 for the spark plugs 26, and EGR for the EGR valve 24, all based on the input signals. Conventionally, the inputs include crankshaft (or camshaft) position as provided by a variable reluctance sensor 34, exhaust gas air/fuel ratio as provided by oxygen sensor 36, intake manifold absolute pressure (MAP) as provided by pressure sensor 38, and intake manifold absolute temperature (MAT) as provided by temperature sensor 39. Other typical inputs include the engine coolant temperature (CT), ambient (barometric) pressure (BARO), fuel rail pressure (FRP), and mass air flow (MAF). For the most part, the control algorithms for generating the fuel and spark control signals are conventional and well known. For example, fuel may be supplied based on MAF, or by a speed-density algorithm (the engine speed RPM being determined from the crankshaft sensor 34), with closed-loop correction based on the feedback of oxygen sensor 36, and spark timing may be controlled relative to crankshaft position based on engine speed and throttle position. Under steady state and slow transient conditions, the closed-loop feedback allows the ECM 12 to reliably control the engine 10 to minimize emissions while maintaining performance and driveability. However, during engine warm-up and significant fueling transients, the sensor 36 is unable to provide adequate feedback information, and the delivered air/fuel ratio deviates from the desired value (typically stoichiometric) due to fuel puddling and variations in fuel volatility as discussed above. Such variability can degrade both emission control and driveability, as also discussed above.

According to this invention, the ECM 12 accounts for the multi-component volatility characteristics of the fuel so that during engine cold-start and warm-up (and optionally during transient fueling conditions), the actual air/fuel ratio more nearly corresponds to the desired value. In general, this invention divides the injected and puddled fuel into a plurality of components characterized by relative volatility, and computes a fuel injection command accordingly. The mass and evaporation characteristics of each component are accounted for separately, with the overall puddle behavior being characterized as the sum of the behaviors of the individual components. The method involves determining, for each engine cycle, the mass of fuel that will evaporate from the puddle, the mass of vapor required to achieve the desired air/fuel ratio for the cylinder, the fraction of the injected fuel that will vaporize, and the mass of fuel that needs to be injected to achieve the desired in-cylinder air/fuel ratio. Finally, the puddle mass of each volatility component is updated for the next engine cycle. In the preferred and illustrated embodiment, the un-vaporized liquid fuel is represented as first, second and third components, respectively characterized by high, medium and low volatility, which is considered to be a good compromise between accuracy and computational complexity.

In the illustrated embodiment, the fuel volatility is inferred based on a measure of the fired-to-motored cylinder pressure ratio (that is, the ratio of the pressure occurring with and without combustion). As explained more thoroughly in related U.S. patent application Ser. No. 09/411,273 filed Oct. 4, 1999, the motored pressure is the pressure that would exist through the cycle if combustion did not occur. Its value can be estimated from a few samples of pressure during compression, using polytropic relations. The ECM 12 determines the pressure ratio with one or more cylinder pressure sensors 40 by forming a ratio of the sensed pressure in a given combustion cycle before and after heat from the combustion can significantly influence pressure. The ratio of fired-to-motored pressure is 1.0 before heat release by the flame, increases as heat is released and after the heat release process is over remains constant through expansion. For a given spark timing, leaner cycles caused by lower fuel volatility burn more slowly. The work lost because the burning did not occur early enough is reasonably estimated by the pressure ratio PR and it acts as a measure of the lateness of the burn. The relationship among the lateness of the burn, the cylinder air-fuel ratio and the fuel volatility provides the basis for volatility detection. A single pressure sensor 40 may be used as depicted in FIG. 1, or alternately, the pressure ratios obtained from sensors responsive to the pressure in two or more cylinders 14 may be averaged.

Figure 2:
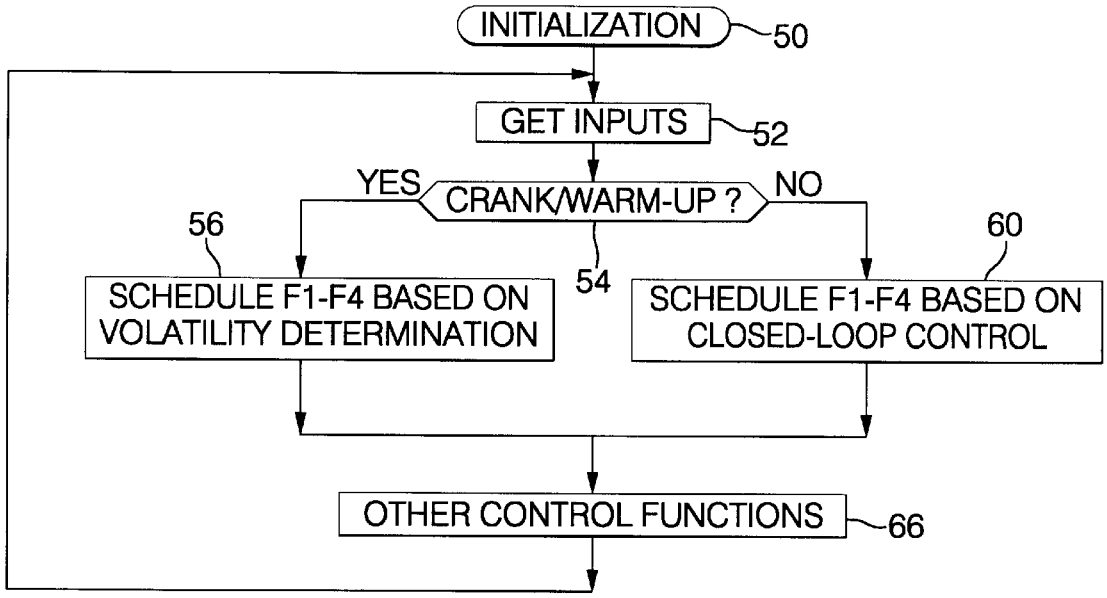
FIGS. 2–4 are flow diagrams representative of computer program instructions executed by the controller of FIG. 1 in carrying out the control of this invention.
Figure 3:
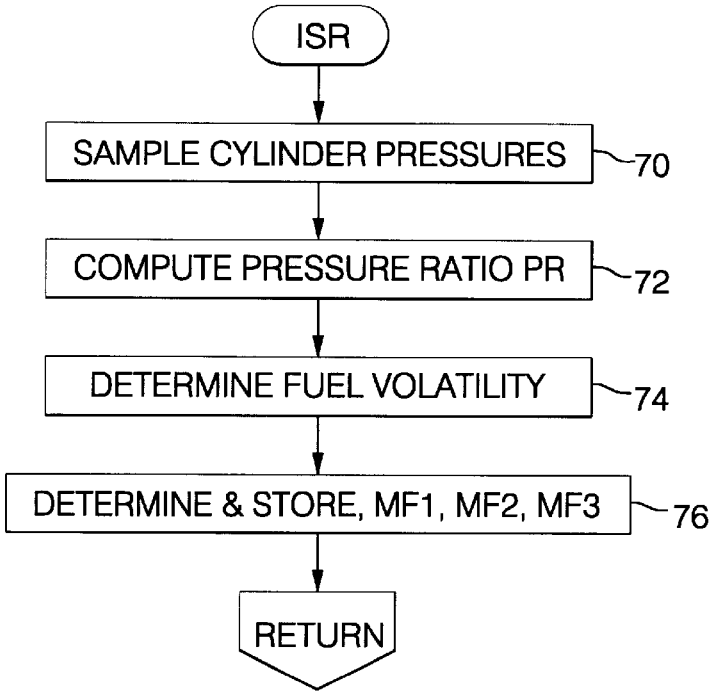
Figure 4:
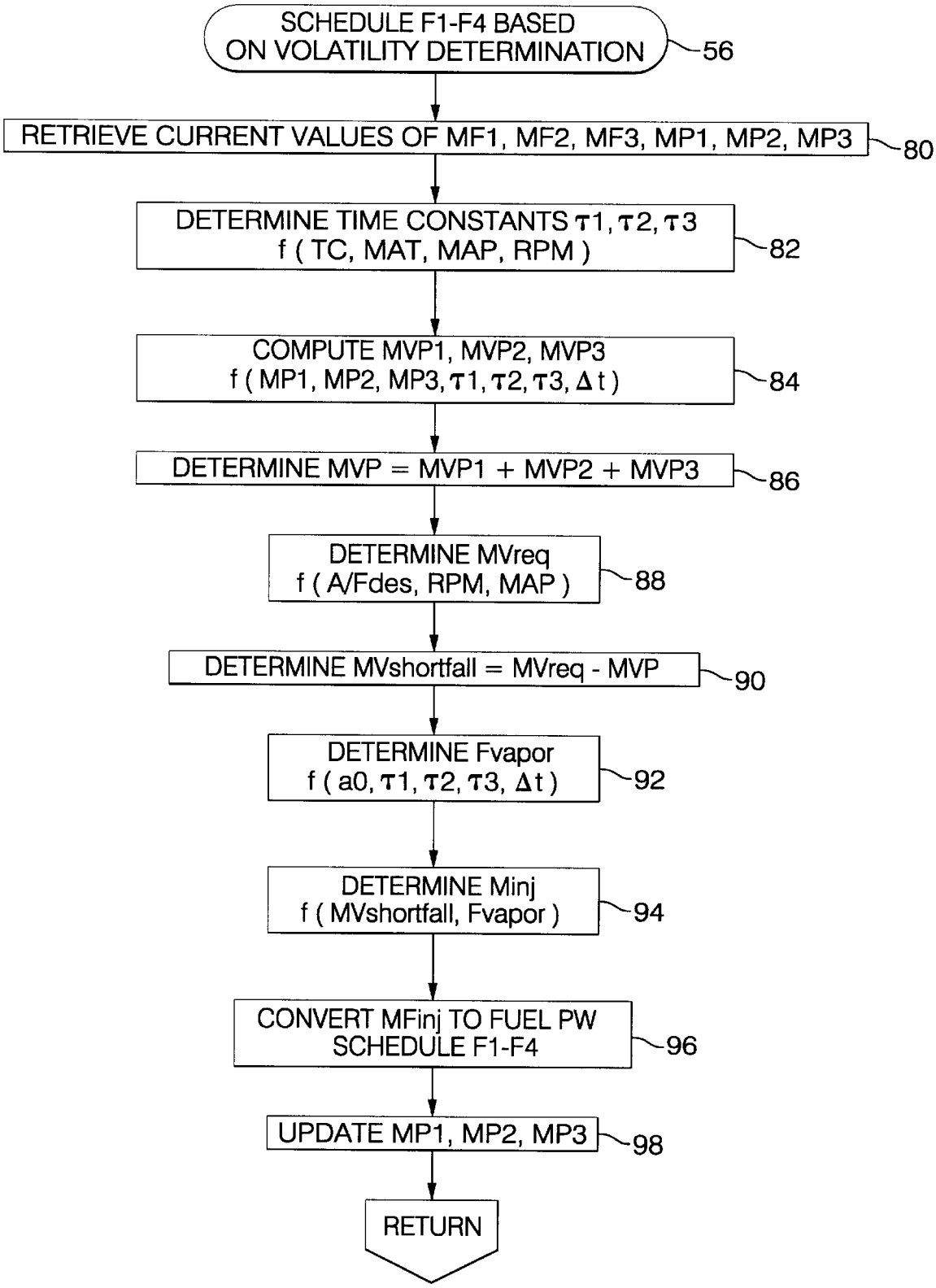

FIGS. 2–4 depict flow diagrams representative of computer program instructions executed by ECM 12 in carrying out the control of this invention. FIG. 2 is a main flow diagram, and embodies conventional fuel algorithms as discussed above, as well as the volatility determination of this invention. FIG. 3 is an interrupt service routine for detecting fuel volatility and the mass fractions MF1, MF2, MF3; and FIG. 4 details the steps for determining a volatility based fuel command.

Referring to FIG. 2, the initialization block 50 is executed at the initiation of each period of engine operation to initialize various parameters and status flags to predetermined initial conditions. This may include, for example, retrieving estimated fuel mass fraction parameters determined in a previous period of engine operation.

Following initialization, the block 52 is executed to read the various inputs mentioned above in respect to FIG. 1. If the engine 10 is in a crank or warm-up mode, as determined at block 54, the block 56 is executed to schedule the fuel control signals F1–F4 based on volatility components in accordance with this invention, as described in detail below in reference to FIG. 4. The fuel volatility may be initialized based on the volatility determined in the previous period of engine operation, and thereafter updated as described below in reference to FIG. 3. Once the engine 10 is no longer in the crank or warm-up modes, again as determined at block 54, the block 60 is executed to schedule fuel control signals F1–F4 based on a conventional closed-loop control strategy, as discussed above.

The above-described operations are repeatedly executed along with other control functions (as indicated by the block 66) as in a purely conventional control. Meanwhile, typically in response to an interrupt signal based on crankshaft position, the ECM samples the output of pressure sensor 40 to determine the fuel volatility and the mass fractions MF1, MF2, MF3 of the injected liquid fuel. FIG. 3 depicts such an interrupt service routine (ISR) in which the cylinder pressures are read and the pressure ratio (PR) is computed at blocks 70 and 72. The block 74 is then executed to estimate the fuel volatility as a function of the pressure ratio PR. The volatility may be determined by correlating the pressure ratik PR with a matrix of empirically determined pressure ratio values that occur with fuels of differing volatility. Alternately, the pressure ratio PR may be used to compute the actual air/fuel ratio ($A/F_{act}$), with the fuel volatility being determined in accordance with the deviation between the computed ratio ($A/F_{act}$) and the desired air/fuel ratio ($A/F_{des}$). Finally, the block 76 is executed to determine and store the fuel mass fractions MF1, MF2, MF3 based on the determined volatility. The fractions MF1, MF2, MF3 of the liquid fuel for a given fuel volatility are engine dependent and are preferably determined empirically as part of the calibration set for a given class of engines.

As indicated above, FIG. 4 details the step of scheduling the fuel control signals F1–F4 based on volatility components according to this invention. First, the stored mass fractions MF1, MF2, MF3 and the fuel puddle mass MP1, MP2, MP3 for each fuel volatility component are retrieved, as indicated at block 80. The fuel puddle masses MP1, MP2, MP3 are initialized to zero at engine start-up and are subsequently updated as explained below to reflect the quantities of un-vaporized fuel for each fuel volatility component in intake manifold 16. The evaporation time constants $\tau 1$, $\tau 2$, $\tau 3$ for the respective first, second and third fuel volatility components are then determined at block 82. As indicated at block 82, the time constants $\tau 1$, $\tau 2$, $\tau 3$ are determined as a combined function of engine coolant temperature CT, manifold temperature MAT, pressure MAP and engine speed RPM. The values for a particular engine geometry may be determined empirically or by mathematical modeling, and in either event, may be stored for later retrieval in the form of a look-up table. The fuel vapor quantities MVP1, MVP2, MVP3 generated by each mass MP1, MP2, MP3 of the puddled fuel are then calculated at block 84. In each case, the fuel vapor quantity is computed as a combined function of the respective puddle mass (MP1, MP2, MP3), the loop time Δt of the routine (corresponding to the time for one engine cycle), and the respective time constant (τ1, τ2, τ3). For example, the vapor quantity MVP1 generated by the first puddle mass MP1 is given according to the equation:

$$MVP1=MP1*(1-\mathrm{EXP}(-\Delta t/\tau 1))$$

As indicated at block 86, the total quantity of vapor MVP generated by the puddled fuel is then simply determined as the sum (MVP1+MVP2+MVP3).

Block 88 then determines the required vapor mass MVreq for achieving the desired air/fuel ratio A/Fdes. This can be simply determined based on A/Fdes and the quantity of air entering the intake manifold 16. The air quantity, in turn, may be determined based on engine speed RPM and load MAP using a speed-density calculation, or may be measured directly by a mass air flow sensor, if desired. Next, the block 90 is executed to compute the vapor mass shortfall MVshortfall according to the difference between the required vapor mass MVreq and the total quantity of vapor MVP generated by the fuel puddle. The shortfall must come from the injected fuel, and blocks 92–94 determine a fuel injection quantity Minj such that the vaporized portion of the injected fuel equals the shortfall. Block 92 determines the fraction Fvapor of the injected fuel that will vaporize, and block 94 determines the fuel quantity Minj based on the vapor shortfall MVshortfall and the fraction Fvapor. The fraction Fvapor accounts both for evaporation from the fuel spray and evaporation after the spray collides with the manifold wall. The evaporation from the fuel spray, given below by the term $a_0$, represents the sum of normal evaporation and evaporation due to blow-back of hot gas from the cylinder 14 upon opening of the respective intake valve 28; the term $a_0$ is therefore specific to the particular engine geometry and valve timing configuration. The evaporation of the spray after collision with the manifold wall is determined similar to puddle evaporation, with the vapor fraction from each volatility component being summed to determine the overall vapor fraction. Thus, the fraction Fvapor may be expressed as:

$$Fvapor=a_0+MF1(1-\mathrm{EXP}(-\Delta t/\tau 1))+MF2(1-\mathrm{EXP}(-\Delta t/\tau 2))+MF3(1-\mathrm{EXP}(-\Delta t/\tau 3))$$

The fuel quantity Minj, in turn, is computed according to the equation:

$$Minj=MVshortfall/Fvapor$$

The block 96 then converts the fuel quantity Minj to a fuel pulse width PW, based on either calculation or table look-up, and schedules corresponding fuel signals F1–F4.

Finally, the block 98 updates the puddle masses MP1, MP2, MP3 for the next engine cycle to account for the vaporized portion of the puddle (which decreases the size of the puddle) and the un-vaporized portion of the injected fuel (which increases the size of the puddle). This can be expressed simply as:

$$MP1=MP1-MVP1+Minj*MF1*\mathrm{EXP}(-\Delta t/\tau 1)$$

$$MP2=MP2-MVP2+Minj*MF2*\mathrm{EXP}(-\Delta t/\tau 2)$$

$$MP3=MP3-MVP3+Minj*MF3*\mathrm{EXP}(-\Delta t/\tau 3)$$

Although not shown in FIG. 4, it is also possible to utilize air/fuel ratio feedback for the purpose of adaptively adjusting the determined volatility. For example, if the measured air/fuel ratio while the fuel is being scheduled by volatility fractionation is significantly richer than the desired air/fuel ratio, it is deduced that the determined volatility is too low, and the volatility is adjusted upward to compensate for the error. Conversely, if the measured air/fuel ratio is significantly leaner than the desired air/fuel ratio, the volatility is adjusted downward to compensate for the error. Such a feedback control is particularly well suited to the pressure ratio method described in reference to FIG. 3, since the method includes air/fuel ratio determination.

In summary, the fuel control of this invention provides improved emission control and driveability, particularly during engine starting and warm-up, by more accurately modeling fuel evaporation characteristics through fractionation based on volatility. Although described in reference to the illustrated embodiment, it will be appreciated that the present invention has much broader application and is not limited thereto. For example, the control may be used in connection with direct injection engines, engines having a different number of cylinders, multiple intake and/or exhaust valves per cylinder, multiple spark plugs per cylinder, and so on. Additionally, the control may remain active for the purpose of scheduling fuel when significant fuel puddling occurs during warmed-up engine operation, such as during throttle transients. Also, various limits may be used to limit the authority of the fuel pulse width commanded by the control. Moreover, as indicated above, the fuel volatility may be determined by methods other than the disclosed method, such as by analysis of engine behavior and/or by employing suitable sensing devices. Accordingly, controls incorporating these and other modifications may fall within the scope of this invention, which is defined by the appended claims.

What is claimed is:

1. A control method for an internal combustion engine in which fuel vapor delivered to an engine cylinder in a given engine cycle is generated in part from liquid fuel delivered by injection for that cycle and in part from puddled liquid fuel from prior injections, the control method comprising the steps of:

modeling the injected and puddled liquid fuel as comprising a plurality of components of varying volatility, each component having a characteristic evaporative time constant;

estimating a mass fraction of each component of the injected liquid fuel and a mass of each component of the puddled liquid fuel;

determining a first quantity of fuel vapor that will be collectively generated in the given engine cycle from said plurality of components of the puddled liquid fuel, based on said evaporative time constants and the estimated masses of puddled liquid fuel;

determining a desired quantity of fuel vapor for delivery to the engine cylinder;

determining a second quantity of fuel vapor to be generated by injected liquid fuel according to a difference between said desired quantity of fuel vapor and said first quantity of fuel vapor;

determining, based on said mass fractions and evaporative time constants, a commanded quantity of injected liquid fuel such that a fuel vapor quantity generated by such liquid fuel in the given engine cycle equals said second quantity of fuel vapor; and injecting liquid fuel into said engine in accordance with said commanded quantity.

2. The control method of claim 1, wherein the characteristic evaporative time constants are individually determined for each of said plurality of components based on predefined parameters and measures of engine temperature, engine speed and engine load.

3. The control method of claim 1, including the steps of:

increasing the estimated masses of puddled liquid fuel to account for an un-vaporized portion of injected liquid fuel; and decreasing the estimated masses of puddled liquid fuel to account for the fuel vapor generated from said plurality of components of puddled liquid fuel.

4. The control method of claim 1, wherein the mass fractions for each of the plurality of components of injected liquid fuel are determined by table look up based on an estimated overall volatility of the injected liquid fuel.

5. The control method of claim 4, including the steps of:

determining the desired quantity of fuel vapor based on a desired air/fuel ratio and a measure of air ingested by said engine;

measuring an actual air/fuel ratio in the engine cylinder;

comparing the actual air/fuel ratio to the desired air/fuel ratio; and adjusting the estimated overall volatility based on the comparison.

6. The control method of claim 5, including the step of:

increasing the estimated overall volatility when the actual air/fuel ratio is richer than the desired air/fuel ratio; and decreasing the estimated overall volatility when the actual air/fuel ratio is leaner than the desired air/fuel ratio.

7. The control method of claim 1, wherein the step of determining the commanded quantity of injected liquid fuel includes the steps of:

determining a fraction of injected liquid fuel that will vaporize in the given engine cycle based on said estimated mass fractions and evaporative time constants; and determining the commanded quantity based on said second quantity of fuel vapor and said determined fraction.

8. The control method of claim 7, wherein the step of determining the fraction of injected fuel that will vaporize in the given engine cycle includes the steps of:

computing a fraction of fuel vapor that will be collectively generated in the given engine cycle from said plurality of components of the injected liquid fuel after injection, based on said evaporative time constants and the estimated mass fractions;

determining a predetermined fraction of fuel vapor that will be generated during injection; and determining the fraction of injected fuel that will vaporize in the given engine cycle according to a sum of said computed and predetermined fractions.

* * * * *